United States Patent [19]

Ferroglio

[11] 4,043,082

[45] Aug. 23, 1977

[54] KNIFE SHARPENING MACHINE WITH AN ABRASIVE BELT

[76] Inventor: Enrico Ferroglio, Viale Catullo 12, I-10.090 Bardassano di Gassino, Italy

[21] Appl. No.: 652,313

[22] Filed: Jan. 26, 1976

[30] Foreign Application Priority Data

Mar. 21, 1975 Italy ..... 67707/75
Sept. 19, 1975 Italy ..... 69335/75

[51] Int. Cl.[2] ..... B24B 21/06; B24D 17/00

[52] U.S. Cl. ..... 51/135 R; 51/148; 51/357

[58] Field of Search ..... 51/135 R, 141, 148, 51/170 EB, 173, 357

[56] References Cited

U.S. PATENT DOCUMENTS

| | | | |
|---|---|---|---|
| 2,055,351 | 9/1936 | Hormel | 51/135 R |
| 2,222,966 | 11/1940 | Williams | 51/135 R |
| 2,423,737 | 7/1947 | Tavano | 51/148 X |
| 2,566,809 | 9/1951 | Risley | 51/148 |
| 2,780,897 | 2/1957 | Radase | 51/141 |
| 2,852,895 | 9/1958 | Lamison | 51/135 |

*Primary Examiner*—Al Lawrence Smith
*Assistant Examiner*—Nicholas P. Godici
*Attorney, Agent, or Firm*—Young & Thompson

[57] ABSTRACT

A knife sharpening machine, using an endless abrasive belt, comprises a pair of guide pulleys around which the belt extends to provide an operative run, with one of the pulleys movable to tauten the belt. A slotted guide in a casing of the machine enables a knife to be presented to the operative run of the belt at a correct angle. The belt and pulleys, as well as an optional resilient support for the operative run of the belt, may all be provided in a removable cartridge.

12 Claims, 4 Drawing Figures

KNIFE SHARPENING MACHINE WITH AN ABRASIVE BELT

BACKGROUND OF THE INVENTION

This invention relates to a machine for sharpening knives, especially but not exclusively knives of the type used for slicing, by hand, meats and similar foods, and which require particularly accurate sharpening.

At present the sharpening of such knives has to be effected by skilled personnel, because only if the operator possesses considerable manual dexterity is it possible to obtain a high degree of sharpness with the machines at present available. This arises primarily from difficulty in keeping the knife suitably orientated relative to the operative abrasive element of the machine during the sharpening. Since sharpening has to be effected frequently in order to keep the knife efficient, the existing machines are relatively uneconomical insofar as labour is concerned.

BRIEF SUMMARY OF THE INVENTION

A principal object of the present invention is to provide a knife-sharpening machine in which provision is made for reliable mutual positioning of the knife being sharpened and the abrasive element, so that sharpening can be effected by unskilled persons, and which can be constructed to a relatively compact size so that it can be installed at the location where the knives are used, and the knives can be resharpened as frequently as may be necessary, that is to say whenever the need for resharpening becomes noticeable.

Another object of the present invention is to provide a machine as above discussed in which the abrasive element is very easily replaceable, so that on the one hand it is easy even for an unskilled user to restore the efficiency of the machine when the abrasive element has worn out, and on the other hand it is possible to exchange the abrasive element in a simple and convenient way so as to allow, for example, the alternative use of a relatively fine abrasive element for a light honing of the edges of the knives, and the use, for example at relatively long intervals of time, of a coarser abrasive element for truing up the edges of the knives for effecting a more thorough resharpening of the knives, when required. This makes it possible to rationalise the maintenance of the knives to the maximum.

The knife-sharpening machine in accordance with the invention comprises an endless abrasive belt extending around guide pulleys, drive means for rotating at least one of said guide pulleys and tautening means for applying tension to said abrasive belt, a slotted guide serving to guide a knife, for sharpening, relative to an operative linear run of said belt, said slotted guide being disposed so as to intersect with the said operative run of the belt at an acute angle so that, in operation, the abrasive belt yields elastically under pressure exerted by a knife introduced into the said slotted guide and adapts itself spontaneously to the profile presented by the knife, in the course of sharpening the latter.

With the machine of the invention, the abrasive belt yields elastically under the pressure of the knife blade introduced into the slotted guide, and deflects thus conforming faithfully the profile of the blade and acting uniformly on said profile. With a suitable choice of the relative dispositions of the abrasive belt and the slotted guide, the machine can be designed to be suitable without having to resort to modification, for sharpening knives of various profiles, thicknesses and shapes, such as are in general use.

The elastic yielding of the belt during the sharpening operation can advantageously be restricted and optimised by the provision of a resilient support arranged to act on the face, not contacted by the knife, of the operative run of the abrasive belt, to restrict the elastic yielding of said belt over at least a part of its length.

In a preferred embodiment of the machine, the abrasive belt, the guide pulleys, and the resilient support when present, are contained in and supported by an enclosure constituting an interchangeable cartridge, simply removably accomodated in a belt housing of the machine, one pulley locating on a driving part of the machine and the other locating over a second shaft preferably arranged for tensioning the belt. In this way there is realised a simple replaceability of the abrasive belt which can be effected when worn out or when change of the type of abrasive belt is required.

The invention also provides, as a further feature thereof, a cartridge, for a knife-sharpening machine as above discussed, characterized in that it comprises an enclosure accomodating a pair of guide pulleys around which extends an endless abrasive belt, said enclosure being of a configuration adapted to the belt housing, for fitting in said housing.

BRIEF DESCRIPTION OF THE DRAWINGS

The invention will be described further, by way of example, with reference to the accompanying drawing, in which.

DETAILED DESCRIPTION OF THE PREFERRED EMBODIMENT

Figure 2:
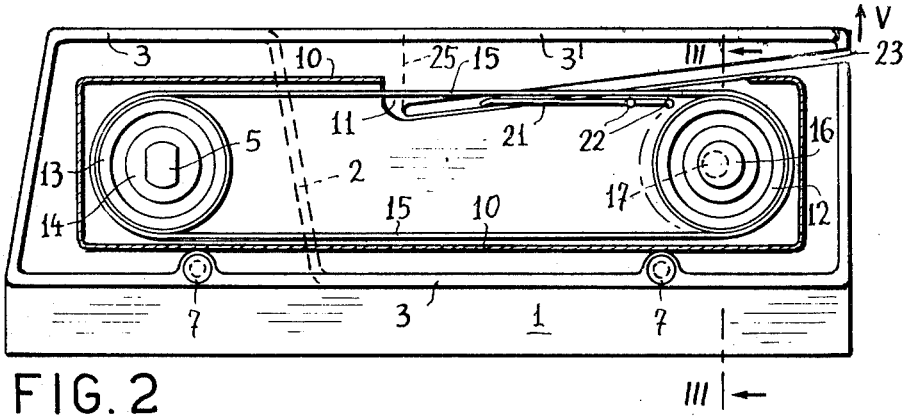
FIG. 2 is an elevation taken as indicated by the arrow II of FIG. 1, with the cover removed and with the abrasive belt cartridge thereof sectioned.

The illustrated machine comprises a casing which, in the example shown, is formed in one piece and which can, for example, be cast, moulded or stamped from metal or synthetic material. The casing comprises a base 1 supporting a motor housing 2 containing an electric motor 4 which constitutes drive means of the machine, and a belt housing 3, open at the front, for accommodating an abrasive belt cartridge generally indicated by the numeral 9. The base 1 can be equipped with feet or other means for fixing the machine to a support surface, (not shown). Shaft 5 of the electric motor 4 projects into the belt housing 3 by a non-circular part thereof, for example, as shown, having two flat faces. The belt housing 3 can be closed by means of a cover 6 fixed, for example, by means of screws 7 and retaining tongues 8 resiliently engaged with respective retaining formations (not visible) in the housing 3, so as to be able to be taken off and replaced easily and without the use of tools.

Figure 3:
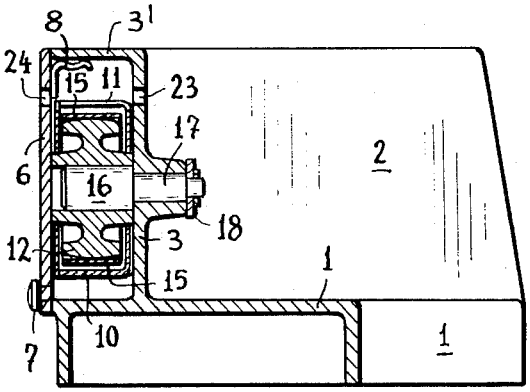
FIG. 3 is a sectional end view taken along the line III—III of FIG. 2.
Figure 4:
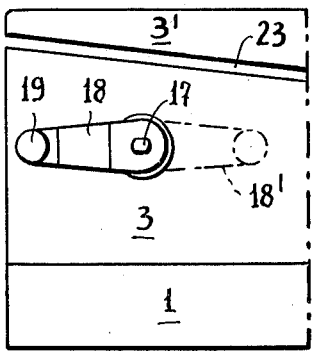
FIG. 4 is a fragmentary elevation taken as indicated by the arrow IV of FIG. 1.

An abrasive belt cartridge 9 accommodated in the housing 3 comprises an enclosure 10 in which there are arranged two guide pulleys 12 and 13, of which the pulley 13 has a hub 14 with a non-circular hole so that the pulley 13 can be fitted on the driving shaft 5. Around the guide pulleys 12 and 13 there is arranged an endless abrasive belt 15 having its operative (i.e. abrasive) surface turned towards the outside. Preferably the guide pulleys 12 and 13 each have a convex outer circumferential surface, as is apparent from FIG. 3, thereby to ensure spontaneous centring of the abrasive belt 15 during operation. Between the guide pulleys 12 and 13 the band 15 defines two almost rectilinear runs, namely an upper operative run and a lower run.

In the belt housing 3 there is disposed, parallel to the driving shaft 5, a stub 16 suitable for receiving the guide pulley 12 of the cartridge 9. The stub 16 is supported eccentrically by a shaft 17 mounted in the housing 3 and provided with an operating lever 18 having a knob 19. The normal operative position of the lever 18 is fixed by a stop 20, on the housing 3, which the lever 18 engages resiliently when it is in the operative position.

Figure 1:
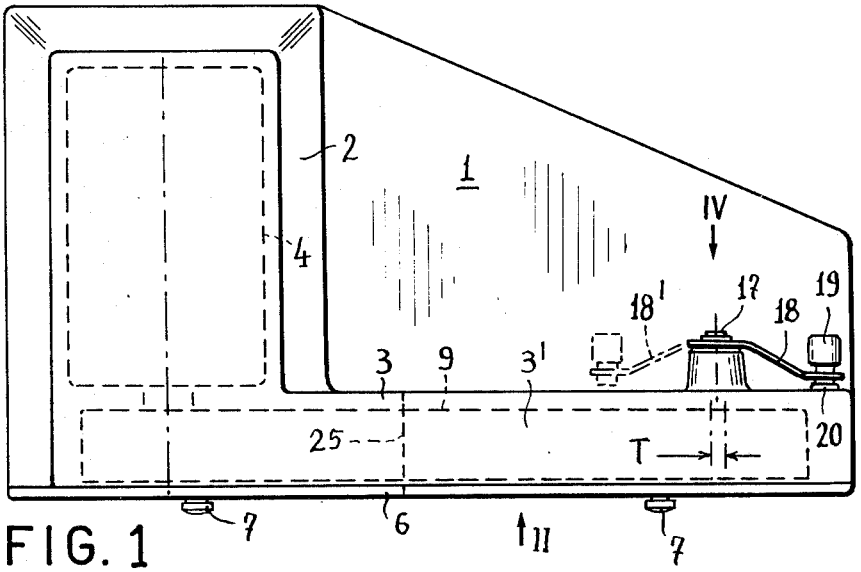
FIG. 1 is a plan view of a preferred embodiment of the knife-sharpening machine of the invention, illustrated on a reduced scale.

By rotating the lever 18, one is able to vary the distance of the stub 16 from the driving shaft 5 by a small amount T, as indicated in FIG. 1, equal to twice the eccentricity of the stub 16 relative to the shaft 17.

Mounted in the interior of the cartridge 9 is a resilient support in the form of a leaf spring 21 arranged parallel to part of the operative run of the abrasive belt 15, at a small spacing from the inner face of the belt 15, this spring 21 being provided with anchorages 22 fixed to the walls of the cartridge 9.

In the rear wall of the housing 3, and correspondingly in the cover 6, there is a slotted guide provided by two slits 23 and 24 respectively, which intersect the operative run of the abrasive belt 15 at a small or acute angle. In correspondence with these slits 23, 24, the enclosure 10 of the cartridge 9 has an open recess 11.

The machine is used as follows.

Assuming initially that the machine is lacking a cartridge 9, the cover 6 is removed and the lever 18 is brought into the position 18' indicated in broken lines in FIG. 1, diametrically opposite to the operative position defined by the stop 20, thereby reducing to the minimum the distance between the stub 16 and the driving shaft 5. The cartridge 9 is then inserted in the belt housing 3, with the pulley 12 being engaged on the stub 16 and the pulley 13 being engaged on the driving shaft 5; the cover 6 is now put back in its place. Upon now bringing the lever 18 back to the operative position, where it is retained by engagement with the stop 20, the stub 16 and with it the guide pulley 12 are moved away from the driving shaft 5 and hence from the guide pulley 13, thus tautening the abrasive belt 15, arranged around the pulley 12 and 13. The machine is ready to function.

The motor 14 having been set in motion, the abrasive belt 15 is driven rapidly. A knife to be sharpened is now inserted in the pair of guide slits 23 and 24 and is thrust to the bottom thereof. As a result, the blade of the knife applies a stress to the operative run of the abrasive belt 15, which yields elastically and assumes a configuration following the profile of the blade and abrading it regularly along the whole of such profile, independently of its dimensions and shape. The abrasive effect is extended to the entire blade by causing the latter to move longitudinally through the slits 23, 24. This having been completed the knife is now turned over and the sharpening is repeated on the other face of its blade, completing the operation.

Therefore the knife to be sharpened has to be applied to the belt only twice in mutually-reversed positions, the knife being introduced each time in the longitudinal direction of the slits 23, 24 and being extracted by drawing it out in its own longitudinal direction. These are extremely easy and smooth operations which do not require any special ability. The correct execution of the operation is ensured by the fact that the abrasive belt 15 follows the profile of the blade, its own inherent elasticity being suitably corrected, for a perfect result, by that of the leaf spring 21 against which the abrasive belt engages so as to be resiliently supported thereby.

When the abrasive belt is worn out, the cartridge 9 is removed from the machine by executing in reverse order the operations above described, and can be thrown away, a new cartridge 9 being inserted in its place. With the same ease, a cartridge 9 containing, for example, a relatively fine abrasive belt can be substituted for a cartridge 9 containing a coarse abrasive belt to enable fine honing and coarse truing and like operations to be carried out as desired.

Naturally details above described by way of example can variously be modified to satisfy different specific requirements, without departing from the scope of the invention as defined by the following claims. For example, the tensioning arrangement 16–20 can be realised differently, possibly in a manner enabling the tension on the belt to be selected or regulated; the resilient support for the operative run of the abrasive belt can be realised differently than by the spring 21, and in certain cases can be omitted; the housing 3 and cover 6 can be omitted for example when the cartridge "per se" is adapted to be connected directly to the base 1, and in this case the slits 23, 24 would be made directly in the walls of the enclosure 10 of the cartridge 9; the cover 6 can be hinged to the base 1; and so on.

The part 3' of the housing 3, which is located above the slit 23, can also be separately-formed relative to the rest of the housing 3, for example along a line of separation 25 indicated as a dotted line in FIGS. 1 and 2, so that the part 3' may be raised as indicated by the arrow V in FIG. 2, for removing it or swinging it back. When this is done one no longer has the slotted guide for a knife blade to be sharpened, which is a characteristic of the machine in accordance with the invention; but then the machine can be occasionally used to sharpen relatively thick blades or blades of a shape such as not to be able to be treated in the manner earlier described and characteristic of the invention, such as blades of hatchets, axes, scythes, cleavers and the like, it remaining true nevertheless that the principal use of the machine remains the one described, in which the slit 23 guides the blade to be sharpened during the sharpening operation.

Although there has been described in detail a machine of the cartridge type, it must be expressly understood that the invention is applicable equally to machines of the type not having a cartridge, in which the guide pulleys 12 and 13 may be firmly fixed to the respective shafts 5 and 16. In this case one no longer has the enclosure 10 constituting the cartridge, and the tautening device 17–20 serves to slacken the belt 15, when it has to be replaced, and for putting under tension the new belt fitted on the guide pulleys 12 and 13.

The invention applies equally to the knife-sharpening machine described and, in the case where this is of the cartridge type, also to the cartridges, of similar or different characteristics, intended for use with such machine.

I claim:

1. In a knife sharpening machine comprising a casing, two guide pulleys mounted for rotation on said casing, drive means for rotating at least one of said guide pulleys, an endless abrasive belt extending around said guide pulleys, tautening means for applying tension to said abrasive belt, said abrasive belt forming between said guide pulleys an operative linear run; the improvement comprising a guide slot for knives, of substantial length and defined by opposite rectilinear parallel side edges of said casing forming an acute angle with said operative run of the abrasive belt, said casing being substantially entirely closed except for said guide slot, whereby in operation a knife to be sharpened is angularly guided by said slot against said operative run of the abrasive belt, and the abrasive belt yields elastically under the pressure exerted by the knife, spontaneously adapting itself to the profile of the knife in course of sharpening, thereby to reduce the danger of injury to a user of the machine and to reduce the escape of dust from the machine.

2. In a knife sharpening machine as set forth in claim 1, further comprising a resilient support in the form of a leaf spring arranged to act on the face, not contacted by the knife, of said operative run of the abrasive belt, in order to restrict the elastic yielding of said belt at least over a part of its length; the improvement that said leaf spring is secured at one end to said casing in the proximity of one of said guide pulleys and extends substantially parallel to a part of said operative run of the abrasive belt at a small spacing from said run.

3. A knife sharpening machine as set forth in claim 1, wherein a part of said casing, defining one side of said guide slot is displaceable in order to allow occasional use of the machine for sharpening blades different from those of knives.

4. A knife sharpening machine as set forth in claim 1, further comprising a cartridge removably mounted on said casing, said cartridge supporting, independently from said casing, said guide pulleys and the endless abrasive belt, at least one of said guide pulleys having coupling means engageable with said drive means.

5. A knife sharpening machine as set forth in claim 4, further comprising a resilient support for the operative run of said abrasive belt, said resilient support being mounted in and supported by said cartridge.

6. A knife sharpening machine as set forth in claim 1, wherein said casing comprises a base, a motor housing and a belt housing, said drive means is an electric motor accomodated within said motor housing, said motor having a shaft and said motor shaft having one end penetrating into said belt housing, said tautening means comprise an eccentric stub penetrating into said belt housing, the first of said guide pulleys is mounted onto said end of the motor shaft and the second of said guide pulleys is mounted onto said eccentric stub, and said guide slot is formed in the walls of said belt housing.

7. A knife sharpening machine as set forth in claim 6, further comprising a cartridge removably mounted in said belt housing, and a resilient support for the operative run of said abrasive belt, said cartridge containing and supporting said guide pulleys, the endless abrasive belt and said resilient support, the first of said guide pulleys having a coupling means and said end of said motor shaft having a coupling means engageable with said coupling means of said first guide pulley, so that worn out cartridges or cartridges containing different abrasive grades may be easily removed and replaced.

8. A knife sharpening machine as set forth in claim 6, wherein the upper part of said belt housing defines one side of said slotted guide and is displaceable in order to allow occasional use of the machine for sharpening blades different from those of knives.

9. A cartridge for a knife sharpening machine that has a casing and a drive means, comprising an enclosure detachably engageable with said casing, two guide pulleys mounted for rotation within said enclosure an endless abrasive belt extending around said guide pulleys and forming between said guide pulleys an operative linear run, and coupling means on one of said pulleys releasably engageable with said drive means, so that worn out cartridges or cartridges containing different abrasive grades may be easily removed and replaced.

10. A cartridge as set forth in claim 9, wherein said enclosure has a portion missing above said operative linear run of the endless abrasive belt.

11. A cartridge as set forth in claim 9, further comprising a resilient support for said operative run of the endless abrasive belt, said resilient support comprising a leaf spring secured at one end to said enclosure in the proximity of one of said guide pulleys and extending substantially parallel to a part of said operative run of the abrasive belt at a small spacing from said run.

12. A knife sharpening machine comprising a base, a motor housing, a belt housing, a guide slot of substantial length defined by opposite rectilinear parallel side edges formed in said belt housing, an electric motor accommodated within said motor housing, said motor having a shaft and said motor shaft having one end penetrating into said belt housing and having a coupling means thereon, tautening means comprising an eccentric stub penetrating into said belt housing, and a cartridge removably mounted in said belt housing, said cartridge comprising an enclosure and in said enclosure two guide pulleys, an endless abrasive belt passing around said guide pulleys and forming an operative linear run at an acute angle with said guide slot, and a resilient support for said operative run of the abrasive belt, the first of said guide pulleys having a coupling means engageable with said coupling means of the motor shaft, and the second of said guide pulleys being engageable with said eccentric stub of the tautening means, so that worn out cartridges or cartridges containing different abrasive grades may be easily removed and replaced.

* * * * *